US005187957A

United States Patent [19]

Yang

[11] Patent Number: 5,187,957

[45] Date of Patent: Feb. 23, 1993

[54] PIN TUMBLER LOCKING MECHANISM

[76] Inventor: Cherng-Lin Yang, No. 30, Yen-Shern Rd., Long-Chuan Village, Nei-Pu Shiang, Ping Tong Hsien, Taiwan

[21] Appl. No.: 879,337

[22] Filed: May 7, 1992

[51] Int. Cl.[5] ..... E05B 27/04

[52] U.S. Cl. ..... 70/493; 70/494; 70/378; 70/409

[58] Field of Search ..... 70/376, 378, 392, 382-385, 70/409, 493, 494, 495, 421, 359, DIG. 21, DIG. 22, DIG. 75

[56] References Cited

U.S. PATENT DOCUMENTS

| | | | |
|---|---|---|---|
| Re. 30,198 | 1/1980 | Oliver et al. | 70/494 |
| 1,304,506 | 5/1919 | Pearson | 70/378 |
| 2,023,847 | 12/1935 | Liss | 70/494 |
| 2,194,469 | 3/1940 | Fremon | 70/378 |
| 2,629,249 | 2/1953 | Mendelsohn | 70/378 |
| 2,660,047 | 11/1953 | Villalba | 70/382 |
| 3,726,116 | 4/1973 | DiMotta | 70/378 X |
| 4,235,086 | 11/1980 | Genakis | 70/378 X |

FOREIGN PATENT DOCUMENTS

| | | | |
|---|---|---|---|
| 653216 | 2/1963 | Italy | 70/378 |

*Primary Examiner*—Lloyd A. Gall

*Attorney, Agent, or Firm*—Bacon & Thomas

[57] ABSTRACT

A pin tumbler locking mechanism comprises an inner cylinder and an outer cylinder which the inner cylinder fits and rotates in. The inner cylinder has a plurality of pin holes for pins to fit and move therein. Each of the pins have a male threaded portion to screw with a female threaded portion and passing through a central nonround hole in a gear to rotate together with the gear by a rack provided on a key. The key is adapted to rotate the gears and the pins together when the key is inserted in or pulled out of a key hole in the inner cylinder so that the pins are raised up or lowered down in the pin holes to have one of their ends protrude in pin holes in the outer cylinder or to hide within the pin holes in the inner cylinder to lock or unlock the mechanism.

6 Claims, 2 Drawing Sheets

PIN TUMBLER LOCKING MECHANISM

BACKGROUND OF THE INVENTION

A conventional pin tumbler mechanism generally has a rotatable inner cylinder for receiving a key inserted into a key hole in the inner cylinder to move pins so that separating lines of the pins can come in line with a contact line of the inner cylinder and an outer cylinder, enabling the inner cylinder to be rotated to unlock a lock. This structure can be illegally pricked open by a very sharp pointed tool, which is inserted in the key hole to move the pins one by one in order. So this kind of lock has a low safety against illegal breakage.

SUMMARY OF THE INVENTION

The pin tumbler locking mechanism of the present invention comprises an inner cylinder fitted rotatably in an outer cylinder. The inner cylinder has a plurality of pin holes in line with pin holes provided in the outer cylinder. The pin holes in the inner cylinder have female-threads adapted to be engaged by a male-thread cuts in pins. The pins are rotated by gears synchronously, and the gears are rotated by a rack provided on one lengthwise side of a key so that the pins can be raised up or lowered down by the combination of the male and the female threads. Therefore, the pins can completely hide within the pin holes in the inner cylinder to prevent the inner cylinder to rotate or can have one of their ends protrude in the pin holes in the outer cylinder to prevent the inner cylinder from rotation.

BRIEF DESCRIPTION OF DRAWINGS

This invention will now be described in detail with reference to the accompanying drawings wherein.

DETAILED DESCRIPTION OF THE INVENTION

Figure 1:
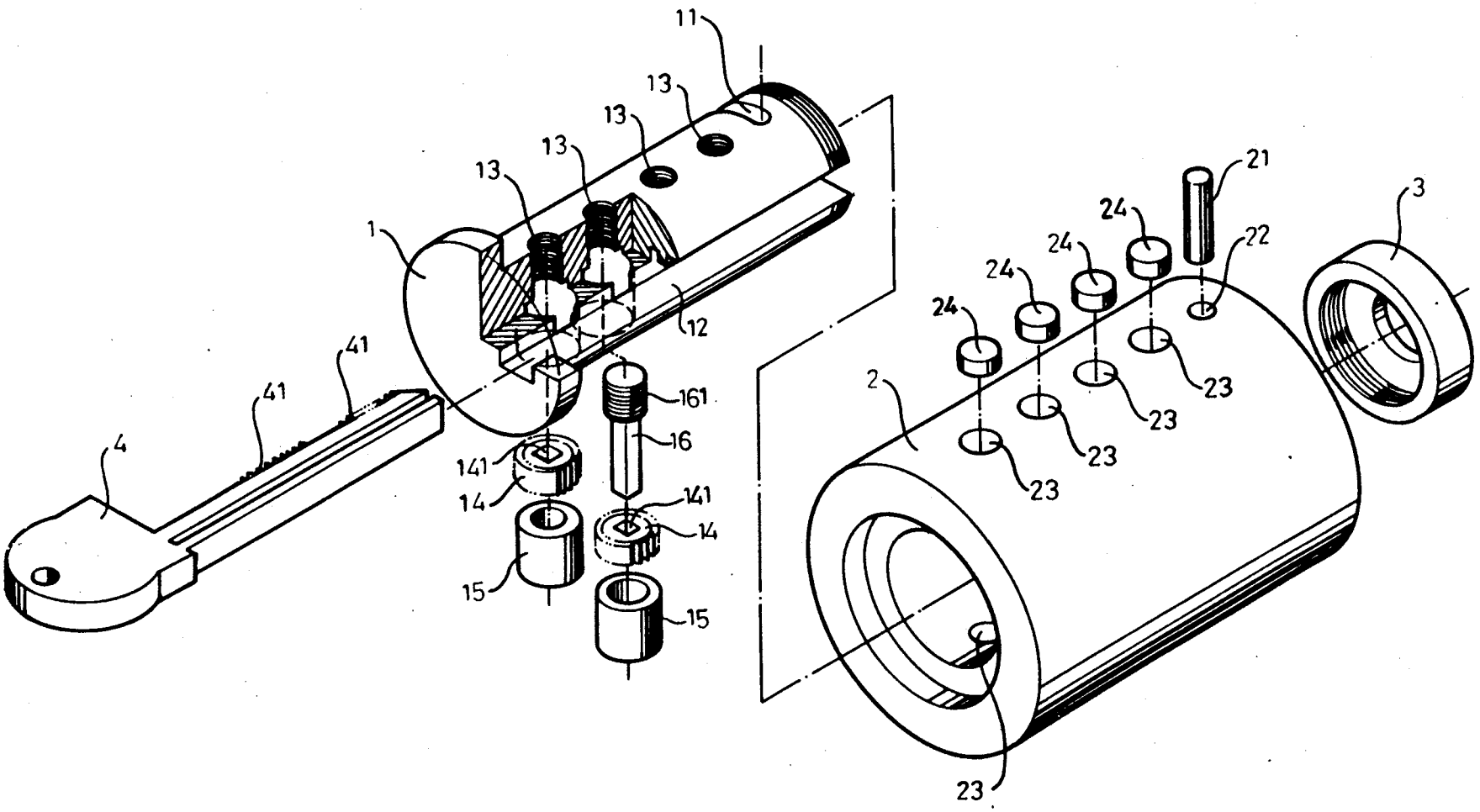
FIG. 1 is an exploded perspective view of the pin tumbler locking mechanism in the present invention.
Figure 2:
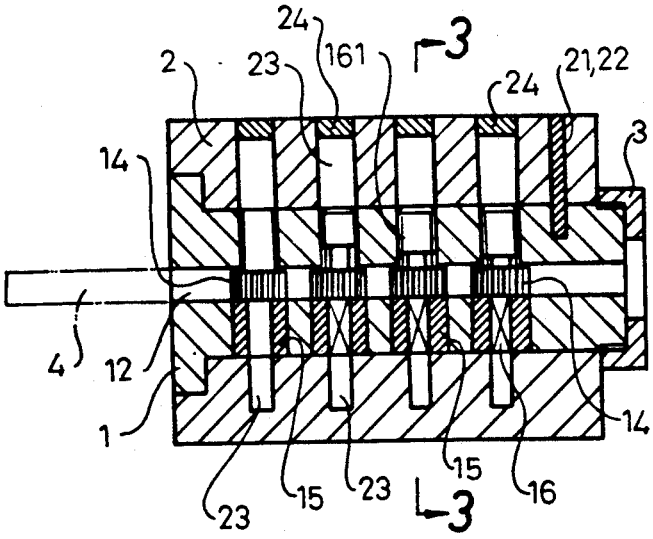
FIG. 2 is a cross-sectional view of the pin tumbler locking mechanism in the present invention.
Figure 3:
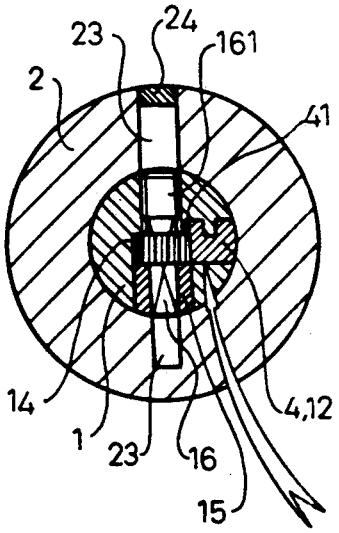
FIG. 3 is a cross-sectional view taken along line 3—3 of FIG. 2.

FIG. 1 shows an embodiment of this invention, a pin tumbler locking mechanism, and any lock comprising a similar locking mechanism should be deemed to be in the scope of this patent application.

The pin tumbler locking mechanism in accordance with the present invention comprises an inner cylinder 1 and an outer cylinder 2. The inner cylinder 1 is fitted in the outer cylinder 2 with, having its end extending out of the outer cylinder 2 to threadedly receive a ring 3 so that the inner cylinder 1 can be secured to rotate therein, and rotates to lock or unlock a lock having this mechanism.

The inner cylinder 1 has a crosswise slot 11 for a pin 21 in the outer cylinder 2 to extend in to limit a turning angle of the inner cylinder 1, a lengthwise key hole 12 for a key 4 to insert therein to rotate the inner cylinder 1 in the outer cylinder 2, a plurality of pin holes 13 having two different diameter portions, a small diameter one and a large diameter one. The pin holes 13 extend crosswise through the inner cylinder 1, the small diameter portion of each pin hole 13 is threaded and the large diameter portion of pin hole 13 is adapted to receive a gear 14 and a bush 15 therein and intersects the key hole 12, allowing the gears 14 to protrude in the key hole 12 to engage a rack 41 in the key 4. The bush 15 supports the gear 14 in the pin hole 13, and the height of the bush 15 together with the gear 14 is the same as or less than the depth of the large diameter portion of pin hole 13, enabling the bush 15 and the gear 14 to stay within the hole 13, not protruding out to obstruct rotation of the inner cylinder 1 in the outer cylinder 2.

Each gear 14 has a square or non-round shaft hole 141 for each radially extending pin 16 to pass through not only to rotate together but also to move vertically in the gear 14. The pin 16 has a male-threaded portion 161 to engage a female-thread in the pin hole 13 so that rotation of the gear 14 can raise up or lower down the pin 16 in the gear 14. The length of each pin 16 is almost the same as the depth of each pin hole 13, so rotation of the pins 16 causes pins 16 to become recessed or to hide within the pin holes 13 in the inner cylinder 1 or to make one of their ends protrude out of the pin holes 13 into pin holes 23 in the outer cylinder 2.

The outer cylinder 2 has an interior for securely receiving the inner cylinder 1 to rotate therein, having a crosswise hole 22 for pin 21 to fit in the slot 11 in the inner cylinder 1 so that the inner cylinder 1 can be secured and can rotate in a definite angle limited by the length of the slot 11. The outer cylinder 2 also has a plurality of pin holes 23 respectively communicating with the pin holes 13 in the inner cylinder 1, and caps 24 adapted to close up the openings of the pin holes 23 to prevent the pins 16 from falling out of the pin holes 23.

Figure 4:
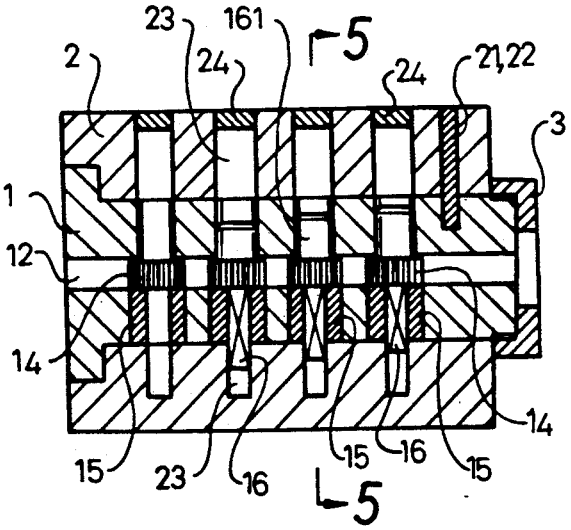
FIG. 4 is a cross-sectional view with a key pulled out of the inner cylinder in the pin tumbler locking mechanism of the present invention.
Figure 5:
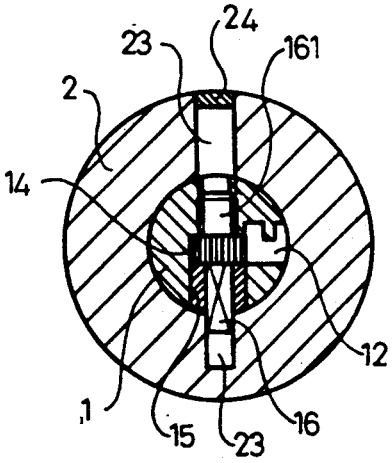
FIG. 5 is a cross-sectional view taken along line 5—5 of FIG. 4.

The key 4 is made to fit in the key hole 12 in the inner cylinder 1, having a rack 41 on one of its lengthwise sides to engage the gear 14 so that when the key 4 is inserted in the key hole 12 in the inner cylinder 1 as shown in FIGS. 4 and 5, the rack 41 can rotate the gears 14, which then rotate the pins 16 to rise up to hide within the pin holes 13, enabling the inner cylinder 1 to rotate. When the key 4 is pulled out of the key hole 12 after being inserted therein, the rack 41 on the key 4 rotates the gears 14 again, and the gears 14 rotate the pins 16, the ends of which then protrude out of the pin holes 13 and extend in the pin holes 23 in the outer cylinder 2 as shown in FIGS. 4 and 5. Then the inner cylinder 1 become immovable in the outer cylinder 2.

The pins 16 in this invention are rotated by the gears 14 which are rotated by a rack 41 in the key 4 to raise up and lower down the pins 16, and so many different keys can be made by changing directions of the rack, the number of teeth in the rack, and the distances among the pins 16.

The pin tumbler locking mechanism will be extremely difficult for a thief to pick since all the pins 16 have to rotate and rise up for opening a lock with this mechanism. Consequently it has an excellent high safety against burglary. Even if the first pin 16 adapted to be shifted by the key 4 should be illegally pricked out, the first gear 14 would rotate idle, but the second, the third gear, and so on, can never be pricked. Even in such a case, a correct key can still be pushed in to rotate the second, the third gears, and so on, to rotate the other pins 16 to rise up for opening this mechanism.

What is claimed is:

1. A pin tumbler locking mechanism comprising an inner cylinder rotatably fitted in an outer cylinder, said inner cylinder having a lengthwise key hole for a key, having a lengthwise rack formed thereon, to extend therein and a plurality of crosswise pin holes intersecting the key hole, said pin holes having a female threaded portion adapted to threadably receive a male threaded portion in each of a plurality of radial pins being movably fitted in said pin holes, a plurality of gears placed in the pin holes and protruding into the key hole, each of said pins being engaged with a respective one of said gears for rotation therewith, wherein when a lengthwise rack carrying key is inserted in or pulled out of the key hole such that the rack engages the gears to rotate the gears, which then rotate the pins at the same time, said pins are raised up or lowered down by the engagement of the male threads of said pins and the female threads in said pin holes so that said pins will become recessed within the pin holes or protrude into aligned pin holes provided in the outer cylinder.

2. The pin tumbler locking mechanism as claimed in claim 1, further including a key having a rack on one of its lengthwise sides, said key being adapted to extend into said key hold and engage and rotate said gears.

3. The pin tumbler locking mechanism as claimed in claim 1, wherein said pin holes in said inner cylinder respectively have a small diameter portion and a large diameter portion, said small diameter portion including said female threaded portion and the large diameter portion receiving a respective one of said gears therein, each said gear having a central non-round hole through which a respective one of said pins extends so that both said gear and said pin can rotate together at the same time while said pin is permitted to move radially in the central hole of said gear.

4. The pin tumbler locking mechanism as claimed in claim 1, wherein said pins are as long as or a little shorter than the depth of said pin holes in said inner cylinder.

5. The pin tumbler locking mechanism as claimed in claim 1, wherein said pin holes in said inner cylinder have a portion intersecting the key hole, and the intersecting portion is only for each of said gears to fit therein for a part of its circumferential teeth to protrude in the key hole, but each said pin does not protrude in the key hole.

6. The pin tumbler locking mechanism as claimed in claim 3, wherein said pin holes in said inner cylinder have a portion intersecting the key hole, and the intersecting portion is only for each of said gears to fit therein for a part of its circumferential teeth to protrude in the key hole, but each said pin does not protrude in the key hole.

* * * * *